US005307701A

United States Patent [19]

Thonnard

[11] Patent Number: 5,307,701

[45] Date of Patent: May 3, 1994

[54] STARTING SYSTEM FOR MODEL ENGINES

[75] Inventor: Paul T. Thonnard, 1833 Halstead Blvd. Apt. #207, Tallahassee, Fla. 32308

[73] Assignee: Paul Thonnard, Tallahassee, Fla.

[21] Appl. No.: 909,688

[22] Filed: Jul. 7, 1992

[51] Int. Cl.[5] ..... F02N 15/02; F02P 19/02

[52] U.S. Cl. ..... 74/7 E; 74/6; 74/7 C; 123/145 A; 123/179.25; 123/DIG. 3

[58] Field of Search ..... 74/6, 7 R, 7 E, 7 C; 123/145 A, 179.25, DIG. 3; 192/42; 446/57

[56] References Cited

U.S. PATENT DOCUMENTS

| | | | |
|---|---|---|---|
| 2,146,733 | 2/1939 | Grozinger | 74/6 X |
| 2,896,601 | 7/1959 | Troeger et al. | 123/179.24 |
| 4,183,341 | 1/1980 | Eastman | 123/DIG. 3 X |
| 4,909,200 | 3/1990 | Sumi | 74/6 |
| 4,930,467 | 6/1990 | Masuda et al. | 123/179.24 |
| 5,088,345 | 2/1992 | Kemmler et al. | 74/598 |
| 5,095,865 | 3/1992 | Keister | 74/7 E |
| 5,159,845 | 11/1992 | Wada et al. | 123/179.25 X |

*Primary Examiner*—Allan D. Herrmann

[57] ABSTRACT

A system for starting model engines. The model engine starting system, in the preferred form, utilizes a motor to drive a torque converting unit. The output of the torque converting unit is mechanically coupled to the crankshaft of an engine through an overrunning clutch so that rotation and torque from the torque converting unit is transmitted to the crankshaft. There is, however, no transmission of rotation or torque in the reverse direction when the engine is running. For glow ignition model engines, a system is described which assists the starting system by controlling the temperature of the glow plug, thus maintaining proper ignition of fuel during starting and running the engine. In order to control the temperature of the glow plug, a control system is utilized to vary the electrical power delivered to the glow plug according to the glow plug's temperature. In the preferred embodiment, the temperature of the glow plug is monitored through the resistance of the glow plug since its resistance is a function of temperature. Changes in the glow plug resistance are detected by a resistor network and result in changes to the duty cycle of the current pulses through the glow plug.

25 Claims, 6 Drawing Sheets

STARTING SYSTEM FOR MODEL ENGINES

FIELD OF THE INVENTION

This invention relates to starting model engines. More particularly, this invention relates to a starting system for model engines, such as an engine used in a remotely controlled model, or any other model or glow ignition engine requiring starting.

DESCRIPTION OF THE RELATED ART

The majority of model engines are started by external means such as turning the engine over by hand, an unwinding spring, or a hand held electric motor. These starting methods are somewhat unsatisfactory because they require considerable skill, and are dangerous, in that once the engine starts, the operator's hands and face are in close proximity to the spinning parts. For model airplanes with glow ignition engines, the hazard to the operator is particularly severe, not only because the spinning propeller is sharp and poorly visible, but also because if preignition occurs and the engine kicks backwards during starting, injury to the operator's fingers is quite common.

A few models use engine starting systems having an electric motor to produce rotation and torque, transmitted through a torque multiplying transmission and an overrunning clutch, to crank the engine during starting. The components of these starting systems are usually not an integral part of the engine and are usually mounted off of the centerline of the engine's crankshaft, resulting in relatively high weight and bulk, therefore making these systems difficult to accommodate in the limited space available in most models. Also, these starting systems usually have exposed transmission components which are unprotected from impacts and abrasive contaminants, giving them a reduced life expectancy. The high weight, bulk, and low durability make these previous engine starting systems more of a novelty than a convenience and safety device for starting model engines.

The limitations of previous glow ignition systems result in several problems for starting glow ignition engines. At low engine starting speeds, preignition occurs if the temperature of the glow plug is too hot, and no ignition results if the glow plug is not hot enough. The majority of glow ignition systems use a single nickel-cadmium, carbon-zinc, or lead-acid electrochemical cell to run current through the glow plug, thus offering no adjustment for glow plug temperature. A more sophisticated power supply that is sometimes used is of the pulsed type where the duty cycle is set by the operator, thereby fixing the average amount of power supplied to heat the glow plug. This type of power supply offers a priori adjustment of power to the glow plug and as it is not able to automatically compensate for varied heat transfer to and from the glow plug under varied engine load conditions and power supply voltages, varied glow plug temperatures result.

Previously, to start most glow ignition engines, extra torque must be used to overcome preignition at low engine starting speeds. Electric starters, therefore, must be powerful enough to overcome preignition when it occurs, or must be able to spin the engine fast enough so that preignition is avoided, hence these starters are heavy and require considerable electrical power. Another problem with previous glow ignition systems arises from the fact that at low idle speeds the glow plug frequently cools to below ignition temperature. Current, therefore, is sometimes supplied to the glow plug in order to give the engine a more reliable idle. Previous glow ignition systems which supply a fixed amount of electrical power to the glow plug at idle, add nearly the same amount of heat to the glow plug as when the engine is starting. The heat from combustion, therefore, added to the electrical power causes unnecessarily elevated glow plug temperatures which can cause the glow plug to burn out prematurely and wastes electrical power.

SUMMARY OF THE INVENTION

To avoid the limitations of previous model engine starting systems, a first object of the invention is to minimize the weight of an engine starting system. A second object is to minimize the space required to mount an engine starting system in a model. A third object of the invention is to provide a means for mounting an engine and an engine starting system to a model. A fourth object is to minimize the possibility of crash damage and wear to the transmission components of an engine starting system.

A fifth object of the invention is to reduce the possibility of preignition in a glow ignition engine during starting by appropriately adjusting the glow plug temperature. A sixth object is to automatically adjust the amount of power supplied to a glow plug so as to keep the glow plug at a preset temperature under all conditions. A seventh object of the invention is to minimize glow plug burn out by reducing the electrical power supplied to a glow plug when it has reached a preset temperature. An eighth object is to minimize electrical power consumption by adding only the amount of power necessary to keep a glow plug at a preset temperature during engine operation.

These and other objects of the invention are provided by a model engine starting system using a rotation and torque producing device with an output shaft transmitting rotation and torque to a torque multiplying device. The torque multiplying device, contained in a housing with bulkhead attachment points, transmits rotation and torque axially to a clutching device which transmits rotation and torque axially to a crankshaft adapter during engine starting. The crankshaft adapter, either a part of the engine's crankshaft or a suitable adapter, transmits rotation and torque axially between the clutching device and the crankshaft. Control of the glow plug temperature in glow ignition engines is provided by a control system which varies the amount of electrical power delivered to the glow plug. In one embodiment of the invention, the control system uses the resistance of the glow plug as a measure of temperature. A preset resistance of the glow plug is sensed in a Wheatstone bridge circuit, giving feedback to a duty cycle modulator which controls the power to the glow plug through a switching device.

DESCRIPTION OF THE PREFERRED EMBODIMENT

Figure 1:
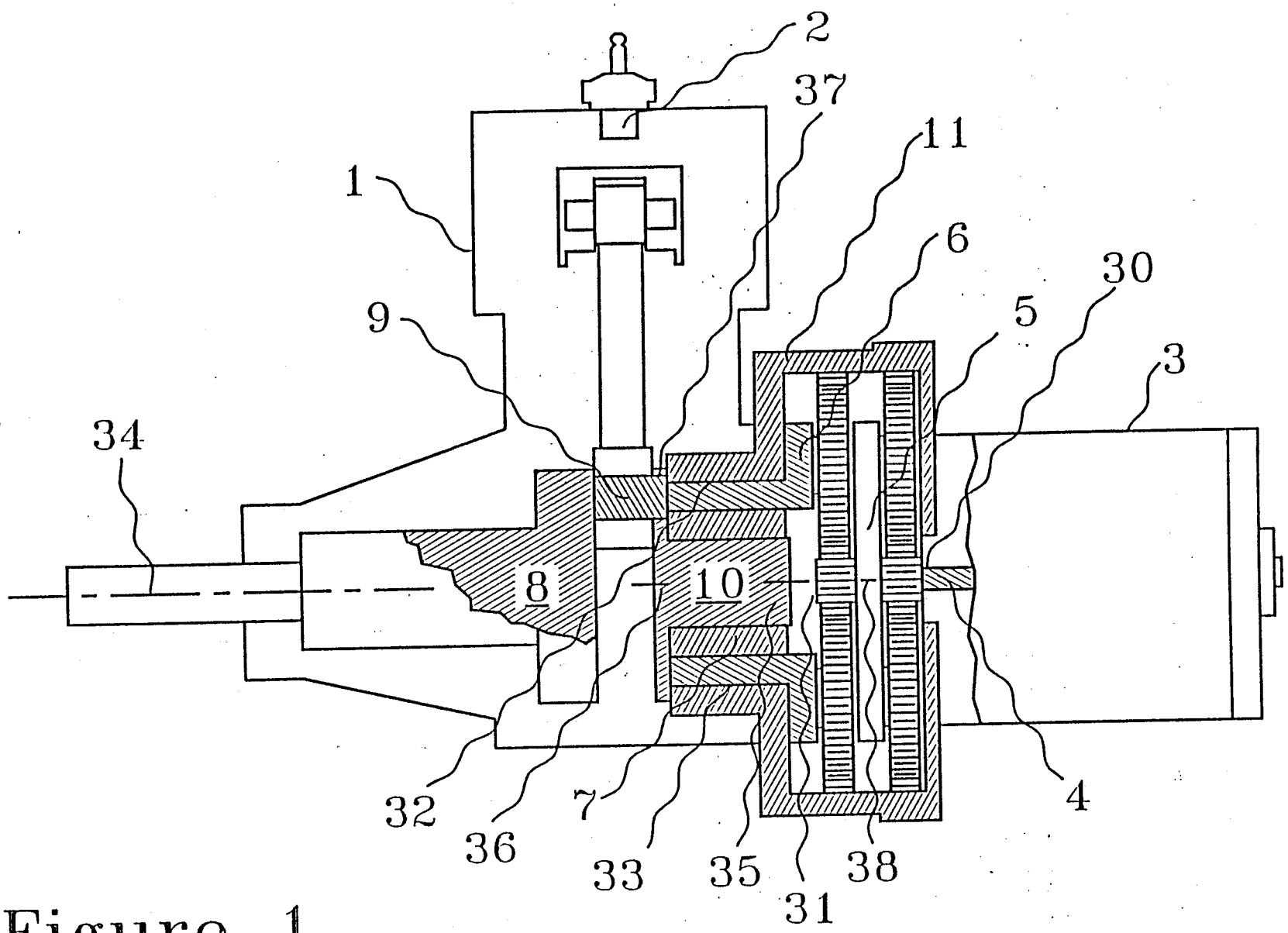
FIG. 1 is a partial cross sectional side view of the components of an embodiment of this invention.
Figure 2:
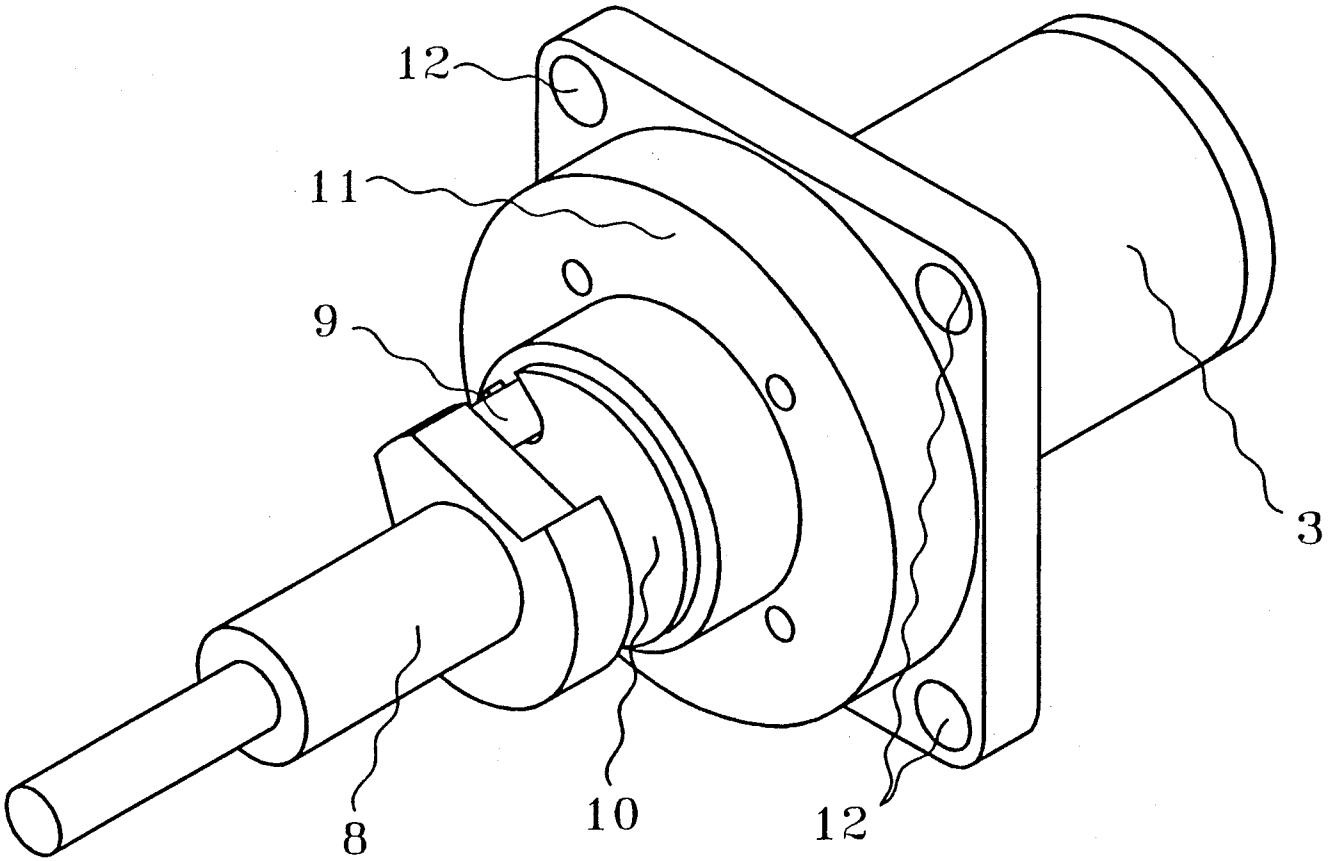
FIG. 2 is an isometric view of an embodiment of the mechanical components of this invention where rotational input to the transmission is along the centerline of an engine's crankshaft.
Figure 3:
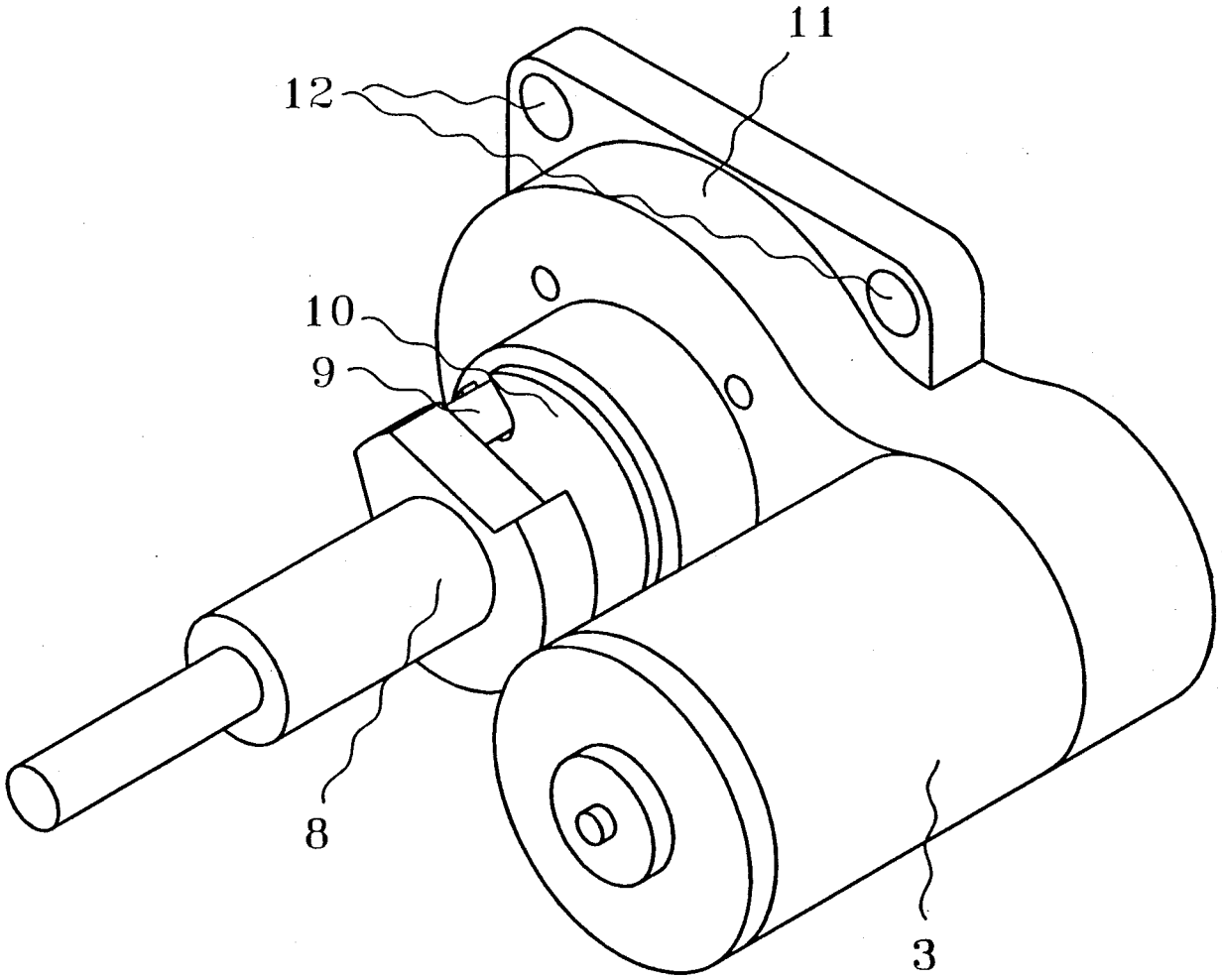
FIG. 3 is an isometric view of an embodiment of the mechanical components of this invention where rotational input to the transmission is offset from the centerline of an engine's crankshaft.

FIG. 1 depicts an embodiment of the invention as it fits to a glow ignition model engine 1, either of two stroke cycle or four stroke cycle design, having a glow plug 2. Although the engine 1 is of the glow ignition type, the invention is suitable for other types of internal combustion engines such as spark ignition engines and diesel engines. In FIGS. 1, 2 and 3, an electric motor 3 converts electrical energy into rotation and torque. The rotation and torque is transmitted from an electric motor output shaft 4 to a an input 30 of a transmission 5 for torque multiplication, shown in FIG. 1. The output 31 from the transmission 5 is transferred to a rotating clutch housing 6 which drives an overrunning clutch 7 mounted within the clutch housing 6; these elements constituting a clutching means. The clutch housing 6 defines an exterior cylindrical support surface 32.

The overrunning clutch 7 transmits rotation and torque to a crankshaft 8 and crankpin 9 via a crankshaft adapter 10, visible in FIGS. 1, 2 and 3.

The crankshaft adapter 10 has a cylindrical portion 35 coaxially positioned within the clutch 7. Further, this adapter 10 has a radial disk portion 36 provided with an eccentrically positioned opening 37 to engage the end of the crank pin 9.

A starter housing 11 contains the components of the starter. The starter housing 11 allows the engine 1 and starter to be attached to a bulkhead in a model by several bulkhead attachment points 12, shown in FIGS. 2 and 3.

In the embodiment illustrated, this housing 11 defines a second cylindrical support surface 33 to receive the support surface 32 of the clutch housing such that the clutch housing rotates on an axis along the centerline 34 of the crankshaft 8 of the model engine 1. It will be recognized by persons skilled in the art that a true bearing member (e.g., a needle bearing), although not shown, can be used between the cited support surfaces.

The electric motor 3 is typically a permanent magnet field, direct current electric motor, however, other electric motors such as wound field, synchronous or direct current motors would work. An electric motor such as the ones used in Skil's model 2105 cordless screwdriver has enough power to start most medium compression model engines that have displacements of less than approximately one cubic inch. For larger displacement or high compression model engines, a more powerful electric motor may be necessary.

The mechanical power supplied by the electric motor 3 is usually in the form of very high rotation speed, such as fifteen thousand revolutions per minute, and very low torque. For this reason, the torque must be increased while reducing the rotation speed. The transmission 5 multiplies the torque from the electric motor 3 by a multiplication ratio suitable for starting the engine 1. A torque multiplication ratio of 50:1 works well in many applications, however, different electric motor and engine combinations sometimes require other ratios. FIG. 1 depicts the starter with a planetary gear transmission. A planetary gear transmission is well suited for applications requiring large torque multiplication ratios as it is easy to stage, and each stage can withstand more power per unit volume than most other types of transmissions having equivalent torque multiplying ratios. The input 30 and output 31 connections of the transmission 5 are along the same axis 38 as the crankshaft adapter 10 thus making a symmetrical package that is easy to mount. Since the length along the crankshaft centerline includes the length of the electric motor 3, as shown in FIG. 2, in instances where the overall length along the crankshaft centerline is limited, the use of other types of transmissions, instead of or in conjunction with a planetary gear transmission, allows the electric motor 3 to be displaced from the crankshaft centerline; a possible configuration of which is shown in FIG. 3. In this configuration, it should be realized that the position of the electric motor 3 and starter housing 11 can be rotated about the crankshaft centerline so as to best fit the particular application.

Referring back to FIG. 1, the output from the transmission 5 is transferred to the clutch housing 6 which rotates about the crankshaft centerline. Many types of clutches could be used to couple power between the starter and the engine 1. The overrunning clutch 7 is particularly well suited for the invention as it allows the engine 1 to be rotated by the starter, yet decouples the engine 1 from the starter as soon as the engine 1 is rotating faster than the starter. The overrunning clutch 7 permits rotation and torque to be transmitted from the clutch housing 6 to the crankshaft adapter 10 while the starter drives the engine 1. Once the engine 1 has started and is driving the crankshaft adapter 10, the overrunning clutch 7 permits the crankshaft adapter 10 to overrun the clutch housing 6. The overrunning clutch 7 should be able to withstand relatively high torque while starting the engine 1 and also high overrun rotation speeds once the engine is operating, especially at full throttle. For most model engines with displacements of less than one cubic inch, an overrunning clutch such as the Torrington RC-061008 Drawn Cup Roller Clutch works well. For larger model engines, a larger and higher torque version of the same clutch, the RC-081208, could be used.

The crankshaft adapter 10 transmits rotation and torque from the overrunning clutch 7 to the crankshaft 8. If the crankshaft 8 supports the crankpin 9 on only one end, and the starter drives the engine 1 from the rear, then the crankshaft adapter 10 must be constructed such that the rotation and torque from the starter is transmitted to the crankshaft 8 through the crankpin 9.

The starter housing 11 is attached to the engine 1 and contains most of the starter's components. The starter housing 11 protects the transmission components from damage caused by a crash. It also keeps abrasive contaminants out of the components while containing lubricants such as oil or grease. If the starter housing 11 is reinforced to bear the load between the engine 1 and a model, bulkhead attachment points 12 can be used to attach the starter and engine 1 to a bulkhead in a model.

During operation, electrical power causes the electric motor 3 to rotate. The transmission 5 multiplies the torque from the electric motor 3 to a level suitable for starting the engine 1. The rotation and torque from the transmission 5 is coupled to the crankshaft 8 through the clutch housing 6, the overrunning clutch 7 and the crankshaft adaptor 10. Once the engine 1 has started, the crankshaft 8 overruns the rotation of the starter and electrical power is disconnected from the electric motor 3.

Figure 4:
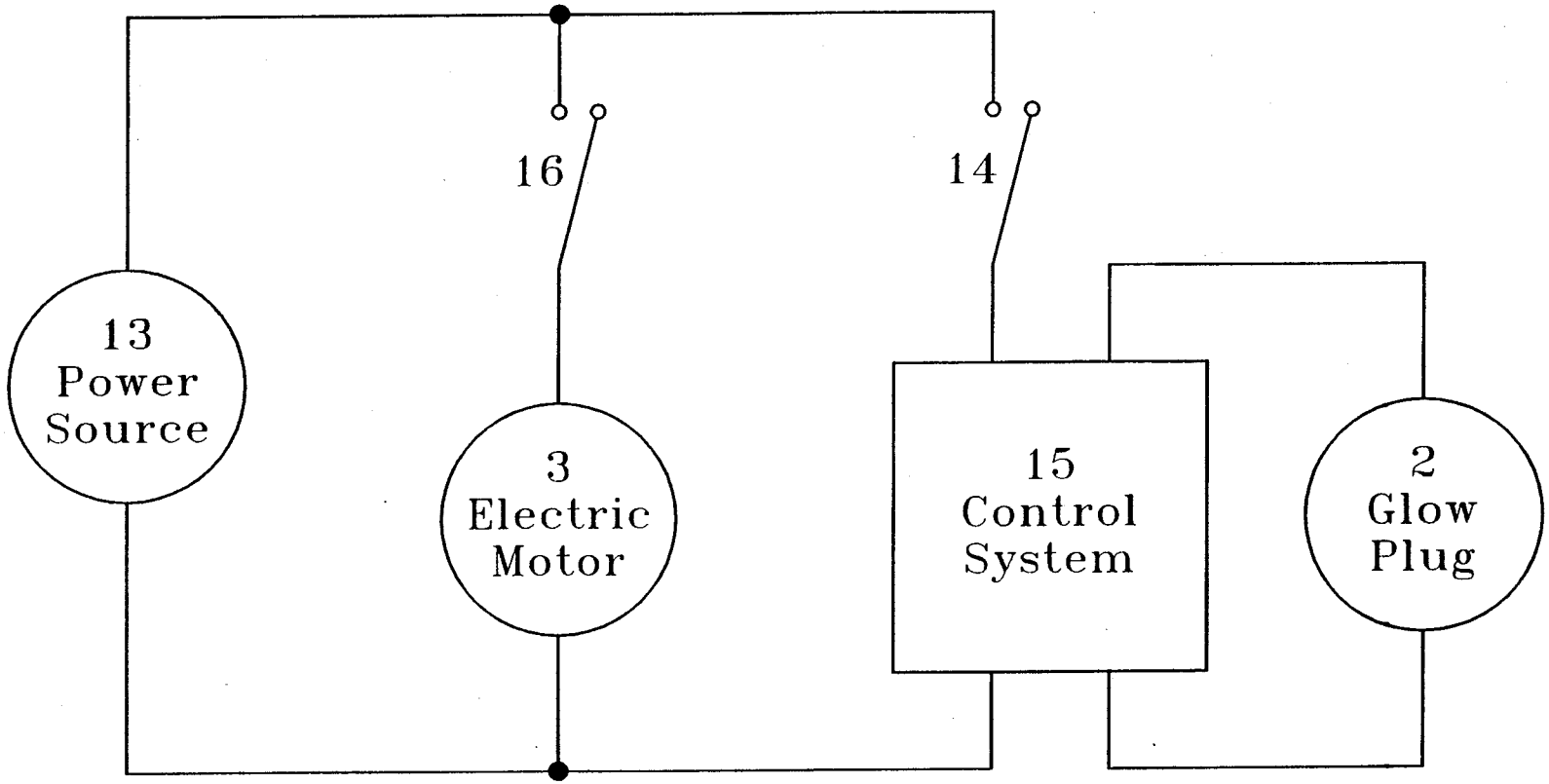
FIG. 4 is a combined simplified schematic and block diagram of an embodiment of the starting system invented.

Elimination of preignition while starting a glow ignition engine is achieved by controlling the maximum temperature of the glow plug 2. In FIG. 4, power from a power source 13, controlled by an ignition switch 14, is used by a control system 15 to maintain the glow plug 2 at a preset temperature. The electric motor 3 also uses power from the power source 13 when the starter switch 16 is energized.

The power source 13 is, typically, a battery constructed of several cells in series such as a 7.2 Volt, 270 mAh battery made from six low resistance, nickel-cadmium cells. This type of battery is relatively lightweight and is usually sufficient to power an electric motor, such as one used in a cordless screwdriver, and a glow ignition system during engine starting. If a higher powered electric motor is used, a larger capacity battery should be used so that its voltage does not significantly drop under the higher current. The starter switch 16 and the ignition switch 14 can be any type of device that can switch current off and on, such as a transistor or a mechanical switch.

During starting, the starter switch 16 and the ignition switch 14 are energized. Current flows from the power source 13 to the electric motor 3 and the control system 15. As the starter rotates the crankshaft 8, the engine 1 draws an air/fuel mixture into the combustion chamber and compresses it. The glow plug 2 ignites the compressed air/fuel mixture so that the engine 1 begins operating under power from combustion. The maximum temperature of the glow plug 2 is set by the control system 15 so that the threshold for ignition is reached near the end of the compression stroke during engine starting. If the glow plug temperature is too hot, preignition occurs and the engine 1 attempts to kick backwards, thus excessively loading the electric motor 3. If the glow plug temperature is not hot enough, then the air/fuel mixture does not ignite and the engine 1 does not start.

After the engine 1 has started, the starter switch 16 is de-energized and the electric motor 3 stops turning. The ignition switch 14 can remain energized, ensuring that the glow plug 2 remains hot even at low idle speeds, or can be de-energized, relying on the heat from combustion to maintain the glow plug 2 at operating temperature. When the engine 1 is not in operation or being started, both the starter switch 16 and the ignition switch 14 should be de-energized.

Figure 5:
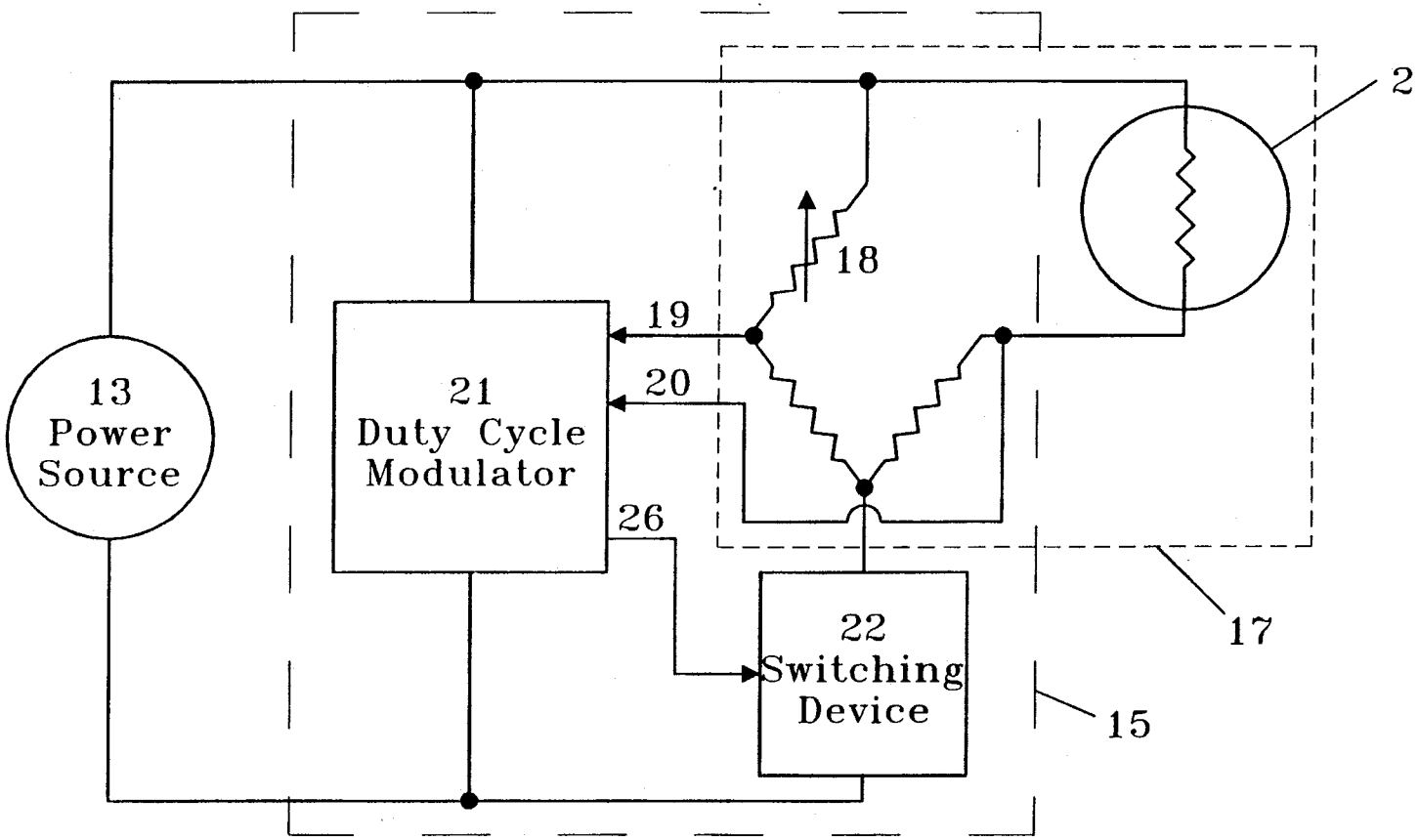
FIG. 5 is a combined simplified schematic and block diagram of an embodiment of the ignition system used with the starting system for glow ignition model engines.

FIG. 5 shows the components which make up an embodiment of the control system 15. A resistor network 17 consists of four resistors, one of which is the glow plug 2 and another is an adjustable resistor 18. The resistor network 17 is arranged as the familiar Wheatstone bridge, well known to those skilled in the art. Those skilled in the art know that other arrangements are possible to sense a change in the resistance of the glow plug 2. The reference voltage 19 and the feedback voltage 20 are connected to a duty cycle modulator 21 which controls a switching device 22. Electrical power is supplied to the control system 15 from the power source 13 when the ignition switch 14 is energized.

The switching device 22 can be a transistor, tube, or even an electromechanical relay. An n-channel power MOSFET such as an MTP10N05 from Motorola, Inc. is well suited for this application. When the switching device 22 is energized, current flows through the resistor network 17 and the glow plug 2 heats up due to the electrical power supplied. The reference voltage 19 and the feedback voltage 20 are substantially equivalent when the ratio of resistances from one bank of resistors is equivalent to the ratio of the other. This phenomena allows the resistance of the glow plug 2 to be compared to a resistance preset in the adjustable resistor 18 as long as the resistances of the other two resistors are substantially constant. Also, when the glow plug 2 is hot, it typically has a higher resistance than when it is at room temperature. A maximum temperature for the glow plug 2, preset as the resistance of the adjustable resistor 18, is therefore detected when the reference voltage 19 is nearly equal to the feedback voltage 20. The duty cycle modulator 21 typically de-energizes the switching device 22 when the feedback voltage 20 becomes less than the reference voltage 19. After a brief pause, the duty cycle modulator 21 re-energizes the switching device 22 and current again flows through the resistor network 18. The cycle usually repeats at a rate which is fast enough to maintain a substantially steady temperature, such as 10 cycles per second or more.

Figure 6:
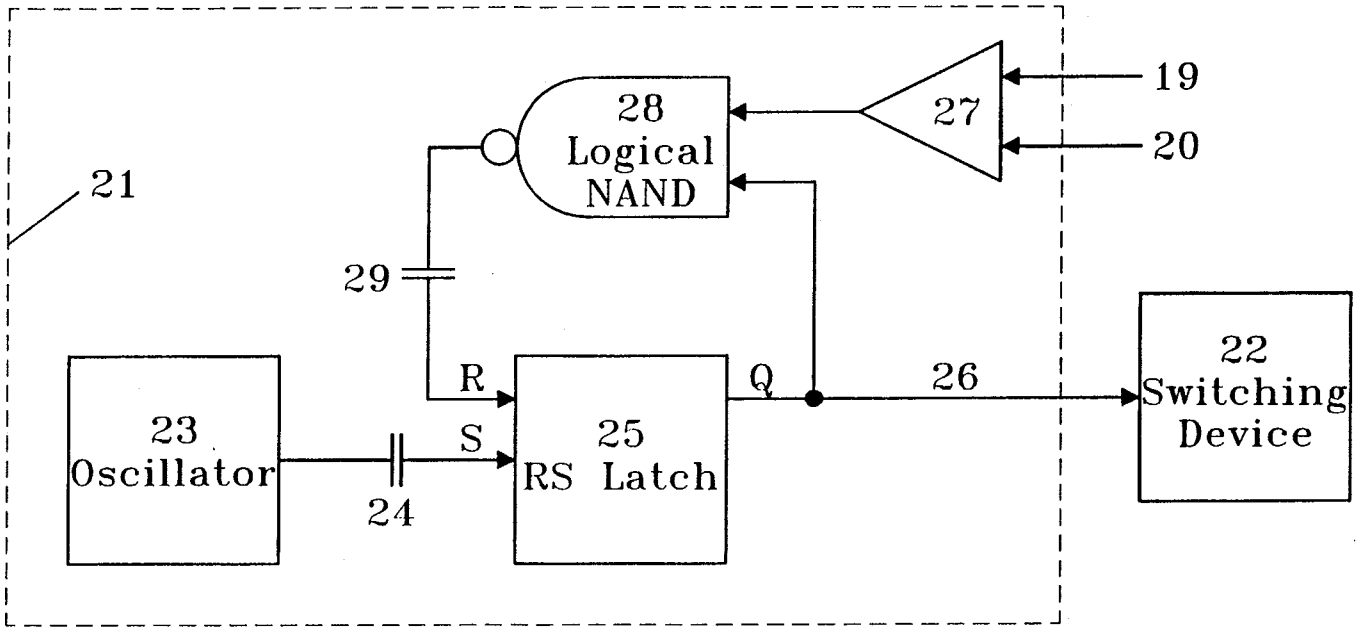
FIG. 6 is a simplified schematic of a duty cycle modulator which is used in this invention.

The duty cycle modulator 21, known to those skilled in the art, can be configured many different ways. FIG. 6 diagrams one possible configuration of the duty cycle modulator 21. Output from an oscillator 23 is differentiated by a first capacitor 24 and used to trigger the S input of an RS latch 25. A Q output 26 of the RS latch 25 controls the switching device 22. A voltage comparator 27 compares the feedback voltage 20 to the reference voltage 19 and sends its output to one input of a logical NAND 28. The other input of the logical NAND 28 is connected to the Q output 26 of the RS latch 25, while the output is differentiated by a second capacitor 29 and used to trigger the R input of the RS latch 25.

The oscillator 23 can be constructed from a TLC555 timer chip and the RS latch 25 can be from a 74HC75 integrated circuit. Similarly, the logical NAND 28 can be a gate from a 74HC00 integrated circuit and the voltage comparator 27 from an LM393 integrated circuit, however, a pull-up resistor on the output is not shown in FIG. 6. After the S input of the RS latch 25 is triggered, the Q output 26 level goes high, and the output level of the logical NAND 28 stays high until the voltage comparator 27 detects that the feedback voltage 20 has dropped below the reference voltage 19. The low level pulse triggers the R input of the RS latch 25 and the Q output 26 level becomes low again, de-energizing the switching device 22. The cycle repeats when the next differentiated pulse from the oscillator 23 triggers the S input of the RS latch 25.

Although the invention is described with respect to a preferred embodiment, modifications thereto will be apparent to those skilled in the art. Therefore, the scope of the invention is to be determined by reference to the claims which follow.

I claim:

1. A starting system for an internal combustion engine, the engine having a crankshaft with a centerline and at least one crankpin, the system comprising:

a rotation and torque producing means;

a torque converting means driven by the rotation and torque producing means, the torque converting means having an input and an output;

a clutching means coupled to the output of the torque converting means, the clutching means rotating on an axis of the output of the torque converting means;

a coupling means received within the clutching means for engaging the clutching means with the crankshaft of the engine to transmit rotation and torque to the crankshaft to start the engine, the coupling means rotating on the axis of the clutching means; and a housing member containing at least the clutching means, the housing member provided with an internal cylindrical support surface to rotationally support the clutching means.

2. The starting system of claim 1 wherein the rotation and torque producing means is an electric motor driven from a power source.

3. The starting system of claim 1 wherein the torque converting means has input and output connections aligned with the crankshaft centerline.

4. The starting system of claim 1 wherein the torque converting means is a planetary gear system.

5. The starting system of claim 1 wherein the torque converting means has input connections off of the crankshaft centerline and output connections aligned with the crankshaft centerline.

6. The starting system of claim 1 wherein the clutching means comprises a clutch housing and an overrunning clutch within the clutch housing interposed between the clutch housing and the coupling means, the overrunning clutch permitting rotation and torque to be transmitted through the clutch housing to the engine from the torque converting means while blocking any transmission of rotation and torque from the engine to the torque converting means.

7. The starting system of claim 6 wherein the coupling means transmits the rotation and torque to the engine crankshaft through the engine crankpin.

8. The starting system of claim 6 wherein the coupling means for transmitting the rotation and torque to the engine crankshaft comprises a cylindrical portion positioned within the clutch and a disk portion attached to the cylindrical portion, the cylindrical portion rotated by the clutch, the disk portion provided with an eccentrically located aperture for engagement with an end of the engine crankpin.

9. A starting system for a glow ignition model engine, the engine having a crankshaft with a centerline, at least one crankpin, and at least one glow plug, the system comprising:

a rotation and torque producing means;

a torque converting means driven by the rotation and torque producing means;

a clutching means coupled to the torque converting means;

a coupling means received within the clutching means for engaging the clutching means with the crankshaft of the engine to transmit rotation and torque to the crankshaft to start the engine, the coupling means rotating on an axis of the torque converting means;

a housing member attached to the engine, the housing member containing at least the clutching means, the housing member provided with an internal cylindrical support surface to receive the clutching means, the housing member provided with attachment means for attachment of the housing member and the engine to a structural member of a model; and an ignition controlling means connected to a power source and the glow plug to limit pre-ignition within the engine.

10. The starting system of claim 9 wherein the rotation and torque producing means is an electric motor driven from a power source.

11. The starting system of claim 9 wherein the torque converting means has input and output connections aligned with the crankshaft centerline.

12. The starting system of claim 9 wherein the torque converting means is a planetary gear system.

13. The starting system of claim 9 wherein the torque converting means has input connections off of the crankshaft centerline and output connections aligned with the crankshaft centerline.

14. The starting system of claim 9 wherein the clutching means is a clutch housing containing an overrunning clutch permitting rotation and torque to be transmitted to the engine from the torque converting means while blocking any transmission of rotation and torque from the engine to the torque converting means.

15. The starting system of claim 9 wherein the coupling means transmits rotation and torque to the crankshaft through the crankpin.

16. The starting system of claim 14 wherein the coupling means for transmitting the rotation and torque to the engine crankshaft comprises a cylindrical portion positioned within the overrunning clutch and a disk portion attached to the cylindrical portion, the cylindrical portion rotated by the clutching means, the disk portion provided with an eccentrically located aperture for engagement with an end of the engine crankpin.

17. The starting system of claim 9 wherein the ignition controlling means controls the temperature of the glow plug for proper ignition timing during engine starting.

18. A starting system for an internal combustion model engine, the engine having a crankshaft with a centerline and at least one crankpin, the engine also having at least one glow plug for ignition within the engine, the system comprising:

an electric motor coupled to a power source for selective rotation of the electric motor to provide rotation and torque;

a planetary gear system driven by the electric motor to multiply the torque of the electric motor and transmit the rotation and torque to an output of the planetary gear system;

a clutch housing connected to the output of the planetary gear system, the clutch housing rotating about the centerline of the crankshaft within a cylindrical support surface;

an overrunning clutch mounted within the clutch housing, the overrunning clutch driven by the clutch housing and having an output along the centerline of the crankshaft;

a coupling means connecting the overrunning clutch with the crankshaft of the engine, the coupling means having a cylindrical portion received within the overrunning clutch and a disk portion attached to the cylindrical portion, the disk portion provided with an eccentrically located aperture to engage an end of the crankpin connected to the engine crankshaft, the overrunning clutch transmitting rotation and torque through the coupling means to the crankshaft while preventing transmission of any rotation and torque from the engine to the planetary gear system;

a housing means for supporting the electric motor, the planetary gear system, the clutch housing, the coupling means and the engine, the housing means providing the cylindrical support surface for the clutch housing, the housing means having attachment points providing for attaching the starting system and the engine to a structural component of the model; and an ignition controlling circuit connected to a power source and to the glow plug to limit pre-ignition within the engine.

19. A system for starting an internal combustion engine, the engine having a crankshaft with a centerline and at least one crankpin, the system comprising:

an electric motor, the electric motor having an output shaft to provide torque and rotation;

a transmission having an input connection receiving the output shaft of the electric motor, and an output connection, the transmission providing an increase in torque and a reduction of rotation speed;

a housing member attached to the engine, the housing member enclosing at least the transmission and defining an internal cylindrical support surface with an axis aligned with the centerline of the crankshaft, the housing member provided with attachment elements to substantially permanently mount the system and the engine to a device, the electric motor being attached to the housing member;

a clutch housing coupled to the output connection of the transmission, the clutch housing rotating on the centerline of the crankshaft, the clutch housing having a second cylindrical support surface supported from the support surface of the housing member;

a clutch mounted within the clutch housing, and coupled with the clutch housing, the clutch rotating on the centerline of the crankshaft; and a coupling element for engaging the clutch with the crankshaft of the engine to transmit torque and rotation to the crankshaft to start the motor, the coupling element having a cylindrical portion positioned within the clutch and a disk portion attached to the cylindrical portion, the disk portion provided with an eccentrically positioned opening to engage an end of the crankpin of the engine.

20. The system of claim 19 further comprising an electrical power source for selectively providing power to the electric motor during a starting cycle.

21. The system of claim 19 wherein the clutch is an overrunning clutch positioned within the clutch housing and connecting the clutch housing with the coupling element for transmitting rotation and torque through the coupling element to the crankshaft while preventing transmission of any rotation and torque from the engine to the planetary gear system, and wherein the output connection of the transmission is aligned with the centerline of the crankshaft.

22. The system of claim 19 wherein the output shaft of the electric motor, the input connection to the transmission, and the output connection of the transmission are aligned with the centerline of the crankshaft, the electric motor being attached to an exterior surface of the housing member.

23. The system of claim 19 wherein the output shaft of said electric motor has an axis parallel to the centerline of the crankshaft, the electric motor being attached to an exterior surface of the housing member.

24. The system of claim 19 wherein the engine has a glow plug for combustion, and further comprises a control circuit connected to the glow plug to control temperature of the glow plug for starting the engine.

25. The system of claim 24 wherein the control circuit senses the temperature of the glow plug and varies electrical power supplied to the glow plug to maintain a selected temperature for proper ignition.

* * * * *